US009750960B2

(12) United States Patent
Fleming et al.

(10) Patent No.: US 9,750,960 B2
(45) Date of Patent: Sep. 5, 2017

(54) RESPIRATORY MASK AND FILTER CARTRIDGE THEREFOR

(71) Applicant: JSP Limited, Oxford, Oxfordshire (GB)

(72) Inventors: Richard James Fleming, Oxford (GB); Clive Johnstone, Oxford (GB); Matthew Neal Judson, Oxford (GB)

(73) Assignee: JSP LIMITED, Oxford, Oxfordshire (GB)

( * ) Notice: Subject to any disclaimer, the term of this patent is extended or adjusted under 35 U.S.C. 154(b) by 306 days.

(21) Appl. No.: 14/321,101

(22) Filed: Jul. 1, 2014

(65) Prior Publication Data

US 2015/0314147 A1 Nov. 5, 2015

(30) Foreign Application Priority Data

May 2, 2014 (GB) ..... 1407817.4

(51) Int. Cl.

| | |
|---|---|
| ***A62B 19/00*** | (2006.01) |
| ***A62B 23/02*** | (2006.01) |
| ***A62B 27/00*** | (2006.01) |
| ***A62B 7/10*** | (2006.01) |
| ***A62B 18/02*** | (2006.01) |
| ***A62B 18/08*** | (2006.01) |

(52) U.S. Cl.

CPC ..... *A62B 19/00* (2013.01); *A62B 7/10* (2013.01); *A62B 18/02* (2013.01); *A62B 18/08* (2013.01); *A62B 23/02* (2013.01); *A62B 23/025* (2013.01); *A62B 27/00* (2013.01)

(58) Field of Classification Search

CPC ..... A62B 19/00; A62B 27/00; A62B 23/025; A62B 23/02; A62B 23/00; B01D 46/0005; B01D 46/02; B01D 46/10; B01D 2259/4541; B01D 35/153; B01D 65/10; B01D 65/102; B01D 65/104

USPC ..... 128/201.17, 202.27, 205.28, 205.29, 128/206.11, 206.12, 206.13, 206.14, 128/206.15, 206.16, 206.17, 206.19

See application file for complete search history.

(56) References Cited

U.S. PATENT DOCUMENTS

| | | | | |
|---|---|---|---|---|
| 5,592,935 A * | 1/1997 | Elstran | ..... | A62B 7/02 128/205.25 |
| 5,647,356 A * | 7/1997 | Osendorf | ..... | A62B 27/00 128/202.27 |
| 2006/0090754 A1 * | 5/2006 | Mittelstadt | ..... | A62B 9/04 128/201.17 |

(Continued)

*Primary Examiner* — Lynne Anderson
*Assistant Examiner* — Elliot S Ruddie
(74) *Attorney, Agent, or Firm* — King & Schickli, PLLC

(57) ABSTRACT

A filter cartridge for a respiratory mask includes a housing comprised of an inner receptacle having an open end and an outer cover mounted over said open end of said inner receptacle. The outer cover includes, in a covering surface thereof, an air intake aperture in fluid communication with said inner receptacle. The outer cover is pivotally mounted to the inner receptacle and configured for pivotal movement relative thereto between a first configuration in which there is a gap between said open end of said inner receptacle and said outer cover such that a respiratory airway is defined between said intake aperture and said inner receptacle, and a second configuration in which said outer cover substantially seals said open end of said inner receptacle and said respiratory airway is thereby blocked.

9 Claims, 7 Drawing Sheets

(56) References Cited

U.S. PATENT DOCUMENTS

| | | | | |
|---|---|---|---|---|
| 2007/0056589 | A1* | 3/2007 | Capon | A62B 23/02<br>128/205.27 |
| 2013/0298512 | A1* | 11/2013 | Symons | A62B 18/08<br>55/490 |
| 2014/0216474 | A1* | 8/2014 | Mittelstadt | A62B 27/00<br>128/863 |
| 2015/0107596 | A1* | 4/2015 | Mashiko | A62B 18/08<br>128/206.15 |

* cited by examiner

RESPIRATORY MASK AND FILTER CARTRIDGE THEREFOR

TECHNICAL FIELD

This invention relates generally to a respiratory mask, particularly but not necessarily exclusively of the type useful for protecting a wearer against gases and vapours, and more particularly to a filter cartridge, disposable or otherwise, for use with such a respiratory mask.

BACKGROUND

Respiratory masks for protecting the wearer against potentially hazardous contaminants in the air, such as particles, gases and vapours, are well known and are becoming an increasingly important item of personal protection equipment (PPE) in some workplaces to protect personnel against such contaminants that might otherwise endanger their health and safety at work, if inhaled.

Respiratory masks that feel the most comfortable to wear have a facepiece moulded of a soft, compliant rubber formed with an inturned cuff or flap having a feathered edge that forms a hermetic seal against the wearer's facial skin. Such a respiratory mask typically has a fitting in each cheek area for a filter cartridge, and replaceable filter cartridges are typically formed with mating threads which enable them to be screwed into place on the facepiece via cooperative mating threads provided on the cheek areas thereof.

There are many different types of replaceable and disposable filter cartridge known in the art, including those in which the filter media is exposed, at least partially, externally of the cartridge, when in use. However, fully encapsulated filter cartridges are preferred in many working environments as they provide protection for the filter media from damage, particularly in wet conditions. Furthermore, potentially hazardous matter captured by the filter media is protected by the outer, encapsulating cartridge casing, thereby avoiding the risk of skin contamination when the filter cartridge is being removed for checking and/or replacement.

A major consideration in relation to respiratory protective equipment (RPE) is to ensure that the mask fits adequately to the user's face as an inadequate fit will significantly reduce the protection provided to the wearer, and create inward leakages of airborne contaminants. Thus, for RPE to be suitable, it must be matched to the job, the environment, the anticipated airborne contaminant exposure level and, importantly, the wearer. RPE fit testing can be periodically performed on-site by a competent person. However, current health and safety regulations also require a pre-use fit check each time a facepiece is worn and before entering the hazardous environment. This is required to determine if the facepiece has been correctly fitted before a contaminated work area is entered.

The pre-use fit check procedure will vary according to the type of respiratory mask used. In the case of a respiratory mask of the types described above, having replaceable filter cartridges mounted on the cheek areas of the facepiece, which allows the respiratory air to be drawn into the cartridge and through the filter media when a user inhales, and expelled through the cartridge when the user exhales, the pre-use fit check procedure will typically comprise securing the facepiece over the user's nose and mouth, and then sealing the respiratory air flowpath, provided via the cartridge, between the user's nose and mouth and the external environment. The wearer then attempts to inhale, whilst the flowpath is blocked, and this action should cause a vacuum to be created within the facepiece (if the mask is correctly fitted), thereby indicating that the seal between the facepiece and the wearer's face is substantially airtight and, therefore, adequate.

An encapsulated filter cartridge typically comprises a two-part plastic casing, within which the filter media is housed and through which the respiratory air flowpath between the inner facepiece and the external environment is provided. Generally, the housing comprises an inner receptacle and an outer cover which mounted to the inner receptacle such that the open end thereof is covered and the edges of the outer cover extend over the open end edges of the receptacle and substantially parallel to the side walls thereof. The outer cover may be slidably mounted, generally centrally, at the longitudinal edges of the inner receptacle, and spring loaded to bias the cover to a normally "open" position, in which there is a gap between the distal edges of the open end of the receptacle and the outer cover which provides the above-mentioned respiratory air flowpath. When sufficient pressure is applied by the wearer to one end of the outer cover to overcome the spring loaded bias, the cover is caused to slide toward the inner receptacle until it hits the distal edges thereof and, thereby, effectively seals the respiratory air flowpath, whilst the applied pressure remains, in order to enable the above-mentioned pre-use fit check to be performed. When the pressure on the outer cover is removed, it returns to its open configuration for normal use of the mask.

However, there are a number of problems associated with such a known encapsulated filter cartridge. Firstly, the above-described mechanism provided for blocking the air flowpath through the cartridge in order to perform the pre-use fit check, is quite cumbersome and not very user-friendly, requiring significant pressure to be applied by a wearer's whole hand in order to effect the sealing process. Furthermore, the sealing function places the outer cover under significant mechanical stress due to the configuration of the sliding mechanism. Another issue associated with the known encapsulated filter cartridges is that of breathing resistance. It will be known to a person skilled in the art that the lower the breathing resistance of a respiratory mask, the more comfortable it will be for a wearer to breathe normally during use. However, conventional encapsulated filter cartridges typically have quite a high breathing resistance, due to the constricted nature of the airway provided and, therefore, can be quite uncomfortable for use over extended periods of time.

SUMMARY

Embodiments of the present invention seek to address at least some of the issues discussed above.

In accordance with an aspect of the present invention, there is provided a filter cartridge for a respiratory mask, the cartridge comprising a housing comprised of an inner receptacle having an open end and an outer cover mounted over said open end of said inner receptacle, said outer cover having, in a covering surface thereof, an air intake aperture in fluid communication with said inner receptacle, said outer cover being pivotally mounted to said inner receptacle and configured for pivotal movement relative thereto between a first configuration in which there is a gap between said open end of said inner receptacle and said outer cover such that a respiratory airway is defined between said intake aperture and said inner receptacle, and a second configuration in which said outer cover substantially seals said open end of said inner receptacle and said respiratory airway is thereby blocked.

In an exemplary embodiment, said cover is pivotally mounted to said inner receptacle by means of a fixed pivot provided at a first longitudinal end thereof. The intake aperture may be provided at a second, opposite longitudinal end of said cover. The inner receptacle may comprise a tapered slider portion on an outer wall thereof, and located at the end adjacent the intake aperture, and wherein a slider support portion is provided on an adjacent inner wall of said cover, said slider and slider support being in slidable communication with each other during movement of said cover between said first and second configurations.

An exemplary embodiment of a filter cartridge of the invention may further comprise a filter media located within said inner receptacle, and oriented substantially parallel to a covering surface of said cover. The intake aperture may be configured to define a respiratory airway which passes over said filter media, in use. The intake aperture may be elongate. The intake aperture may be elongate in a direction substantially orthogonal to the longitudinal axis of said cover.

In an exemplary embodiment, the cover may comprise a covering surface and peripheral sidewalls, the plane of said sidewalls being substantially orthogonal to the plane of the covering surface, said sidewalls extending over the edges of said inner receptacle defining said open end thereof, said intake aperture being provided in said covering surface, and the cartridge being configured such that, in said second configuration, the edges of said open end of said inner receptacle are in close contact with the cover at or adjacent the location at which the sidewalls extend from the periphery of the covering surface. A further respiratory airway may be defined by said gap between the open end of said inner receptacle and said cover, in said first configuration.

In an exemplary embodiment, the filter cartridge may comprise a connecting portion configured to mount said cartridge over a respiratory aperture in a respiratory mask. A flexible diaphragm may be provided in said connecting portion of said filter cartridge. The filter cartridge may be disposable.

BRIEF DESCRIPTION OF THE DRAWINGS

These and other aspects of the present invention will become apparent from embodiments of the present invention which will now be described by way of examples only and with reference to the accompanying drawings, in which.

DETAILED DESCRIPTION

Figure 1:
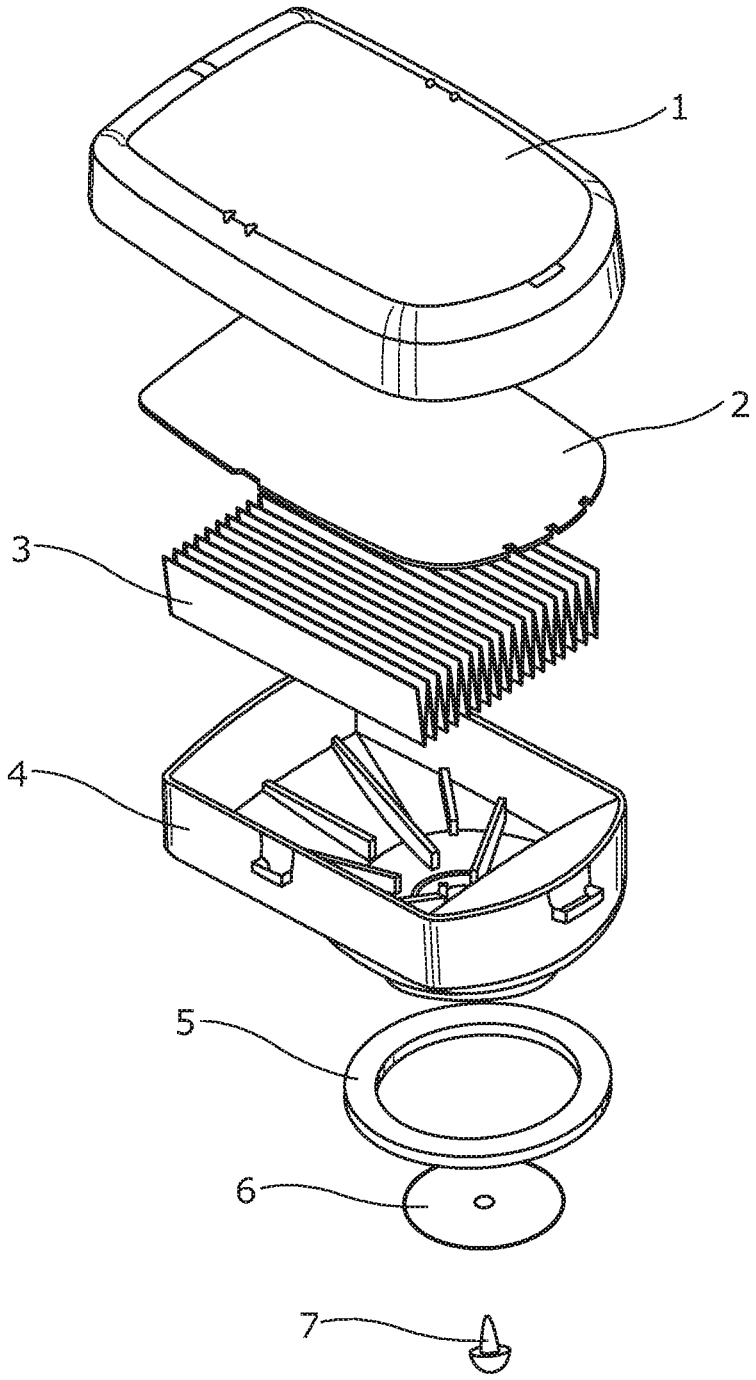
FIG. 1 is an exploded perspective view of the principal elements of a filter cartridge according to an exemplary embodiment of the present invention.
Figure 2:
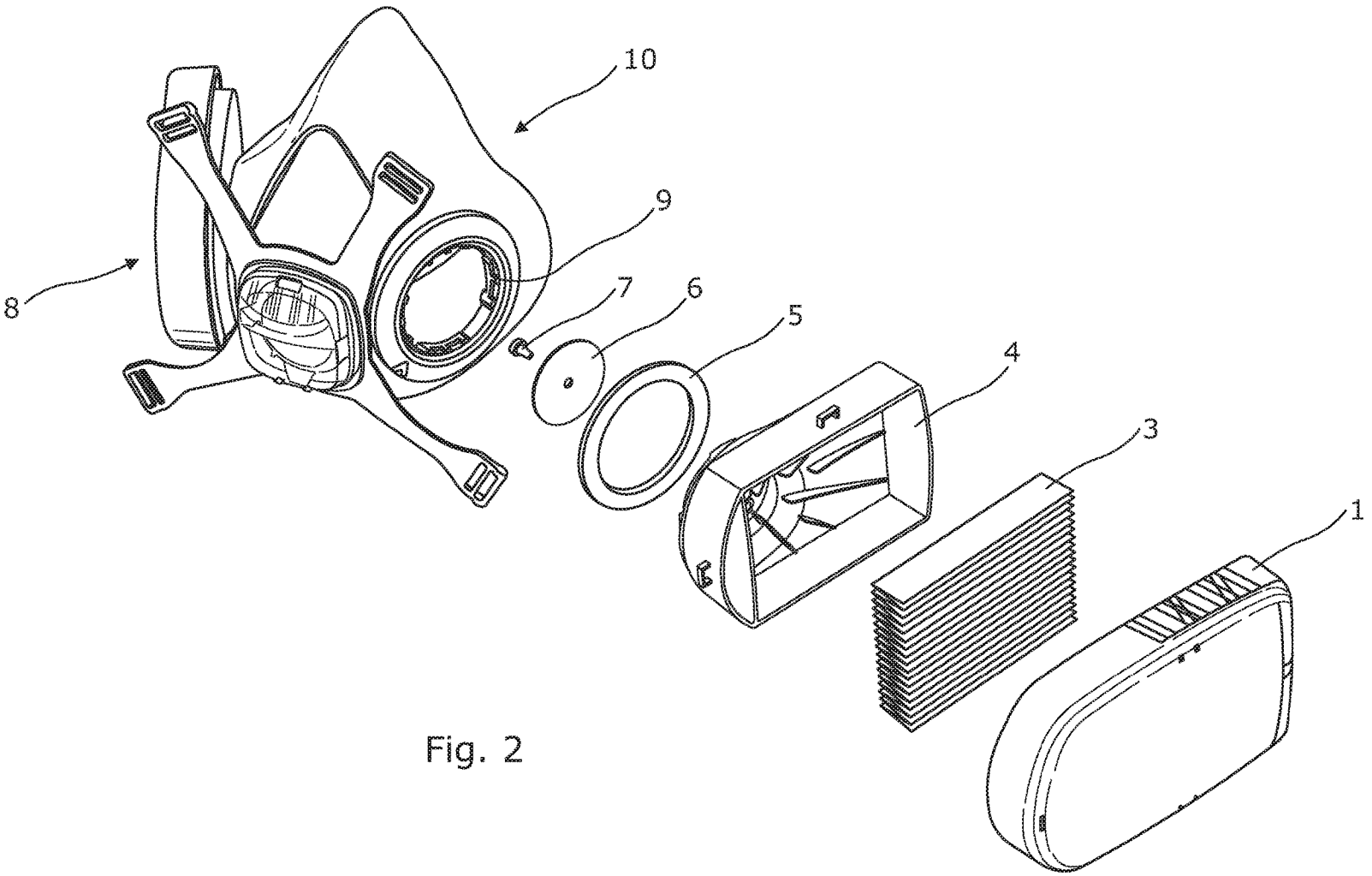
FIG. 2 is an exploded perspective view of the filter cartridge of FIG. 1 in relation to a respiratory mask.
Figure 3:
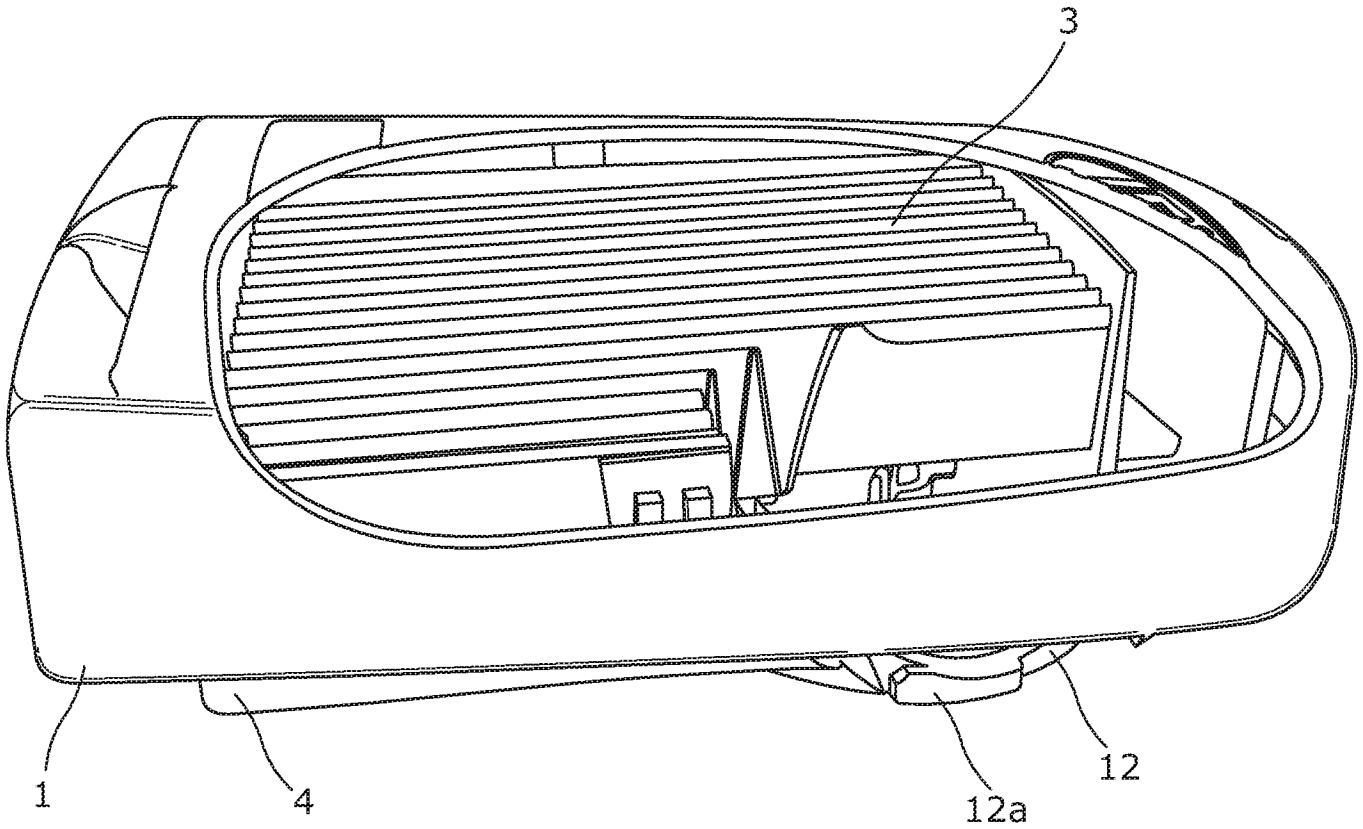
FIG. 3 is a cut-away perspective view of the filter cartridge of FIG. 1 in its assembled configuration.

Referring to FIG. 1 of the drawings, a filter cartridge according to an exemplary embodiment of the present invention comprises a housing cover 1, a cover gasket 2, filter media 3, a housing base 4, a base gasket 5, a diaphragm 6 and a diaphragm pin 7. Each of these elements fits together to form a filter cartridge 8, which can be mounted to a respiratory mask 10 via a cooperative mating thread 9 provided in the cheek area of the mask facepiece, as illustrated in FIG. 2 of the drawings. In its assembled configuration, as shown in FIG. 3 of the drawings, the filter media 3 is held within the housing base 4 and covered by the housing cover 1 and housing gasket 2, with the side walls of the housing cover 1 extending over the open end of the housing base and extending substantially parallel to the side walls of the housing base 4.

Figure 4:
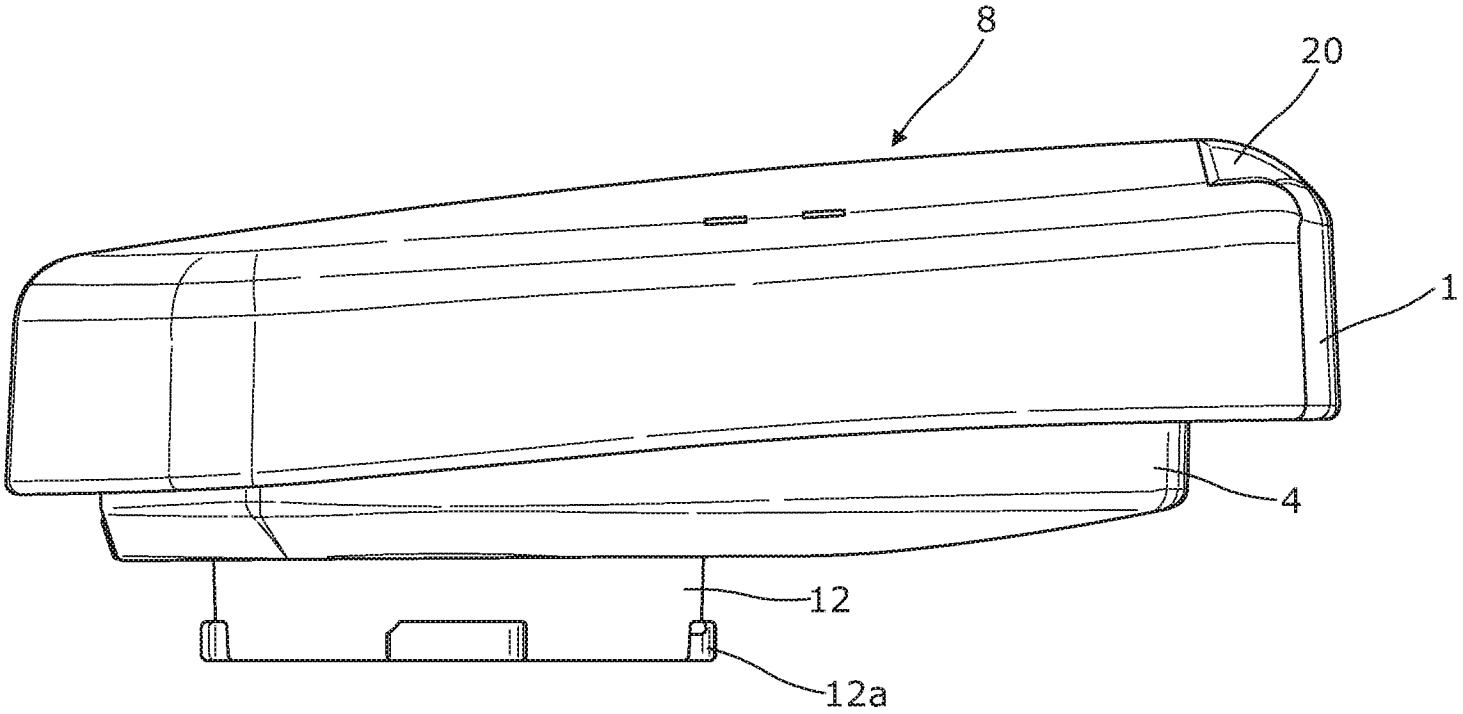
FIG. 4 is a schematic side view of a filter cartridge according to an exemplary embodiment of the present invention.
Figure 5:
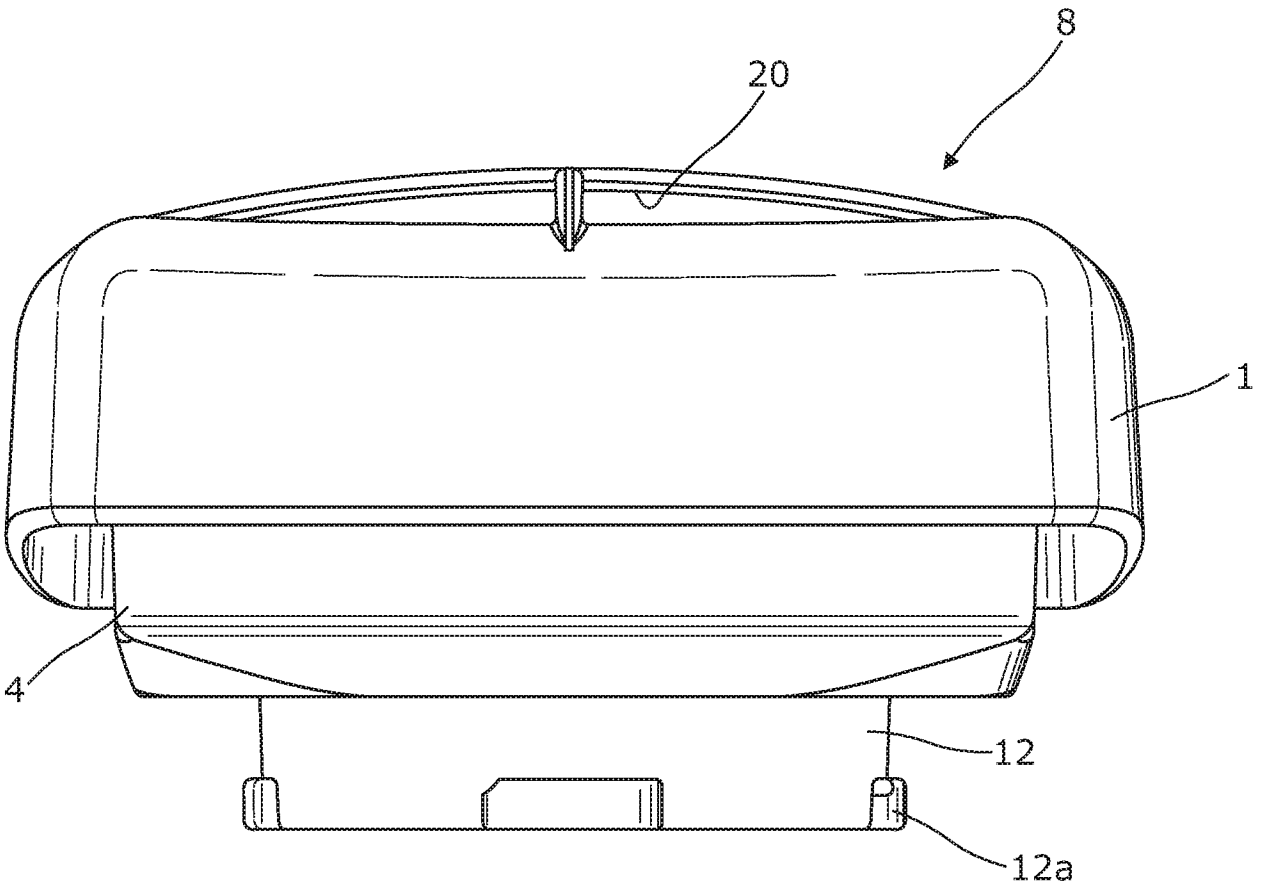
FIG. 5 is a schematic end view of the filter cartridge of FIG. 4.
Figure 6:
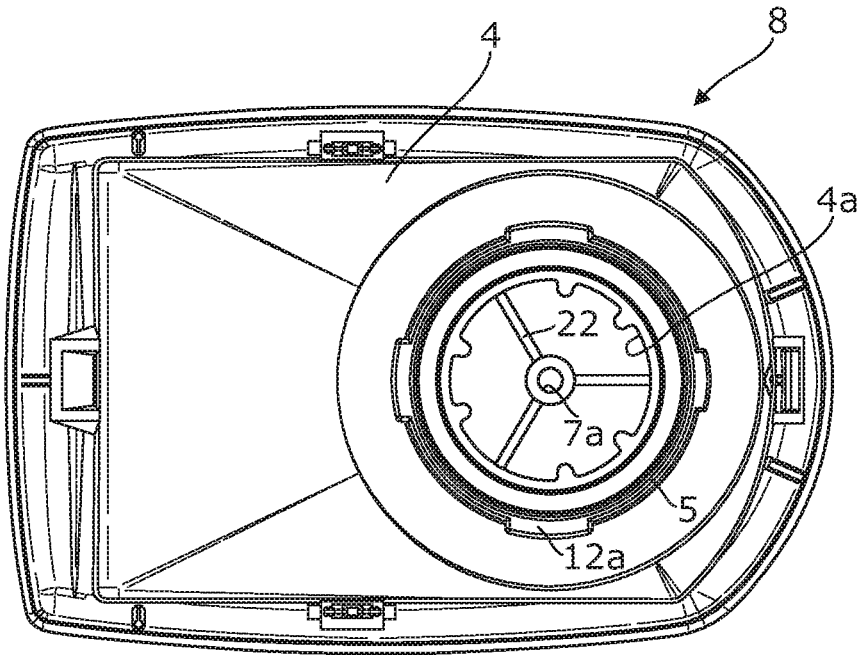
FIG. 6 is a schematic bottom view of the filter cartridge of FIG. 4.
Figure 7:
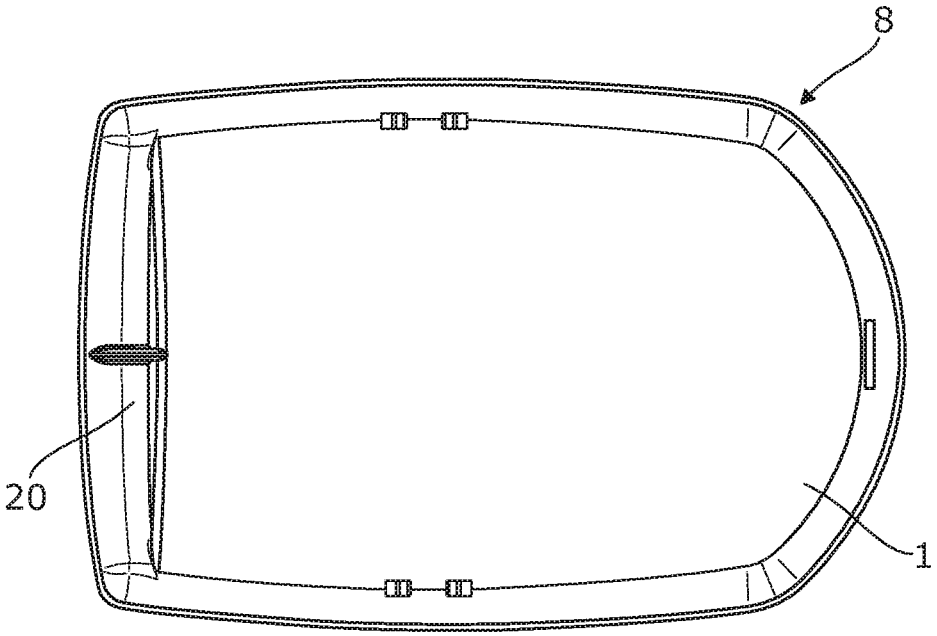
FIG. 7 is a schematic plan view of the filter cartridge of FIG. 4.

Referring to FIGS. 4, 5 and 6 of the drawings, it can be seen that an elongate air intake aperture 20 is provided at one end of the housing cover 1, which extends through the cover 1 so as to provide an airway which is in fluid communication with the interior of the housing base 4. Furthermore, the housing base 4 is provided with a cylindrical 'plug' portion which extends from a substantially circular aperture 4*a* in the housing base 4 and has, at its distal end, 4 equi-distant, circumferential ribs 12*a* for cooperation with the mating thread (9—FIG. 1) provided on the facepiece of a respiratory mask. The base gasket (5—FIG. 1) is secured on the housing base 4 around the 'plug' portion 12 to facilitate sealing of the filter cartridge against the facepiece, in use.

The housing base aperture 4*a* is spanned by three equi-angular support struts 22 which are connected together generally centrally via a substantially circular pin hole 7*a*. A diaphragm (6—FIG. 1) is provided over the aperture 4*a*, and supported by the struts 22, and then secured in place by a pin (7—FIG. 1). The provision of the diaphragm on the cartridge 8, i.e. the replaceable portion of the overall respiratory mask, rather than on the facepiece thereof, provides an additional advantage of this embodiment of the present invention relative to the prior art, in that the diaphragm, which itself is susceptible to damage, contamination and general wear and tear, is simply replaced every time the cartridge is replaced.

Figure 8A:
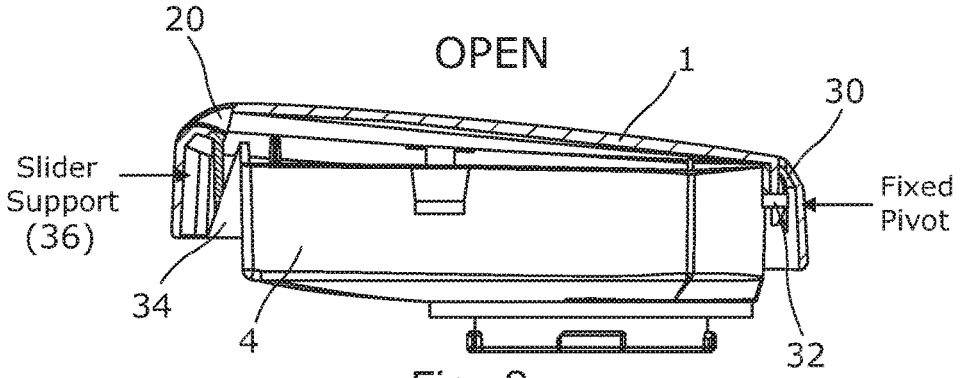
FIG. 8*a* is a schematic cross-sectional view of the filter cartridge of FIG. 4, in an open configuration, for normal use.

Referring to FIG. 8*a* of the drawings, the inner surface of the housing cover 1 is provided, at the end opposite that having the intake aperture 20, with a pivot pin 30 which is cooperatively engaged within a pivot loop 32 provided on an outer wall of the housing base 4. The pivot pin 30 and pivot loop 32 together form a fixed pivotal connection between the housing cover 1 and the housing base 4 when the filter cartridge is in its assembled configuration. In this configuration, the inner surface of the housing cover 1 is in contact with the adjacent edge of the housing base 4, but at the opposite end of the cartridge, adjacent the intake aperture 20, there is a gap between the edge of the housing base 4 and the inner surface of the housing cover 1, thereby defining a airway between the intake aperture 20 and the filter media housed within the housing base 4. The open end of the housing base 4 is provided with an outwardly tapering slider 34 which is slidably engaged with a cooperative support tab 32 which extends from the inner surface of the housing cover 1.

Figure 9:
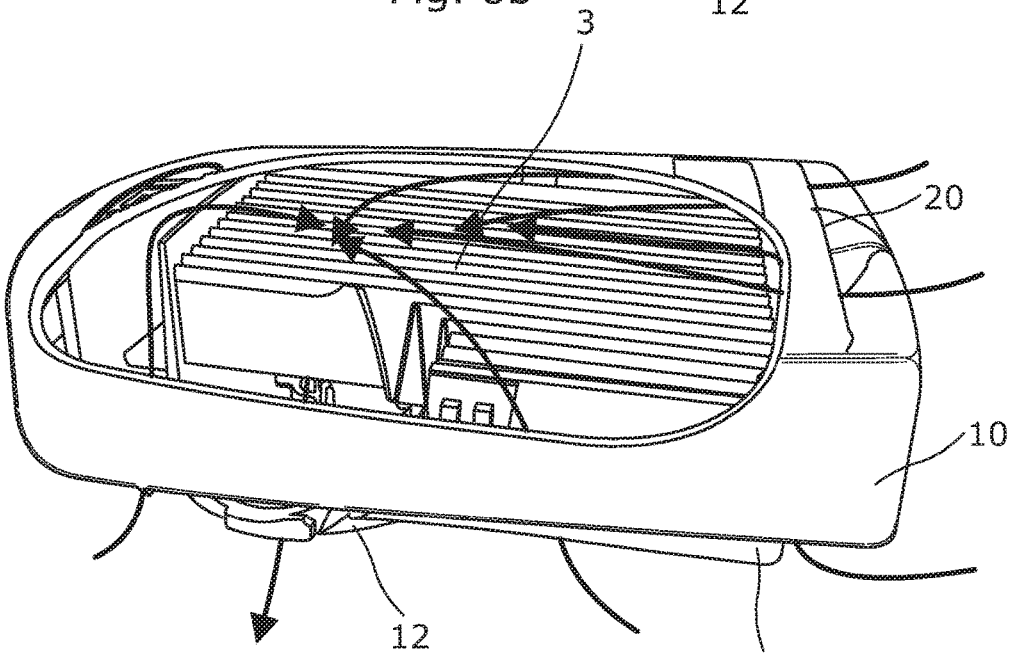
FIG. 9 is a cut-away perspective view of the filter cartridge according to an exemplary embodiment of the invention, illustrating the airways provided during normal use.

Referring to FIG. 9 of the drawings, during normal use, when the filter cartridge is secured to the facepiece of a respiratory mask and a wearer inhales, air intake paths are defined between the parallel respective sidewalls of the housing cover 1 and the housing base 4, such that air enters the housing base 4 and passes through the filter media 3, before leaving the cartridge through the 'plug' portion 12 and reaching the wearer's nose and mouth within the facepiece, as illustrated by the arrows in FIG. 9. In addition, a further air intake path is defined by the intake aperture 20, through inhaled air enters the housing base 4 and passes through the filter media 3, before again leaving the cartridge through the 'plug' portion 12 and entering the breathing space defined by the facepiece, also illustrated by the arrows in FIG. 9.

Thus, it can be seen that the intake aperture 20 increases the amount of inhaled air hat can enter the housing base 4, thereby serving to decrease breathing resistance compared with prior art devices. Furthermore, relative performance is improved because air can be drawn across the whole surface of the filter media.

Figure 8B:
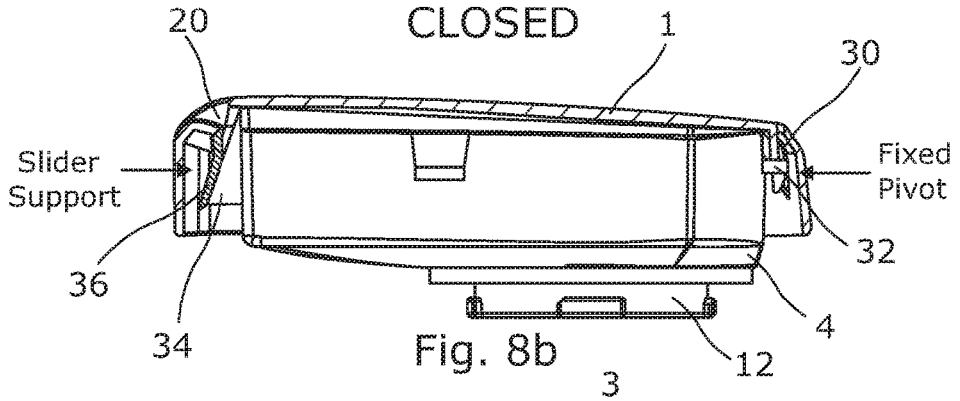
FIG. 8*b* is a schematic cross-sectional view of the filter cartridge of FIG. 4, in a closed configuration, for use in a pre-use check procedure.

Referring to FIG. 8*b* of the drawings, in order to perform a pre-use check in respect of a respiratory mask carrying cartridge filters as described above, a wearer simply needs to 'pinch' the open end of the filter cartridge between their thumb and forefinger in order to pivot the open end of the housing cover 1 toward the open end of the housing base 4, so as to bring the inner surface of the housing cover 1 into contact with the whole periphery of the housing base opening. As the housing cover 1 pivots, the tapered support slider 34 slides along the slider support 36, which has the additional benefit of providing the user with a more tactile response and feel during the operation. In the closed configuration, the housing base is sealed by the housing cover and all airways are blocked, thereby enabling the pre-use check to be performed. The open configuration is achieved once again simply by releasing the open end of the filter cartridge, such that the spring biased pivot at the opposite end causes the housing cover 1 to return to its open state.

It will be apparent to a person skilled in the art that modifications and variations can be made to the described embodiments without departing from the scope of the invention as claimed.

The invention claimed is:

1. A filter cartridge for a respiratory mask, the cartridge comprising a housing comprised of an inner receptacle having an open end and an outer cover mounted over said open end of said inner receptacle, said outer cover having, in a covering surface thereof at a first longitudinal end of said housing, an air intake aperture in fluid communication with said inner receptacle, said outer cover being pivotally mounted to said inner receptacle by a fixed pivot provided at an opposite second longitudinal end of said housing and configured for pivotal movement relative thereto between a first configuration in which there is a gap between said open end of said inner receptacle and said outer cover such that a respiratory airway is defined between said intake aperture and said inner receptacle, and a second configuration in which said outer cover substantially seals said open end of said inner receptacle and said respiratory airway is thereby blocked; wherein a further respiratory airway is defined by the gap between the open end of said inner receptacle and the cover in said first configuration; and wherein the inner receptacle further comprises a connecting portion adjacent the second longitudinal end of said housing configured to mount the filter cartridge over a respiratory aperture in the respiratory mask, said connecting portion and said intake aperture being located at opposing longitudinal ends of said housing.

2. The filter cartridge according to claim 1, further comprising a filter media located within said inner receptacle, and oriented substantially parallel to the covering surface of said cover.

3. The filter cartridge according to claim 2, wherein said intake aperture is configured to define the respiratory airway which passes over said filter media, in use.

4. The filter cartridge according to claim 1, wherein said intake aperture is elongate.

5. The filter cartridge according to claim 4, wherein said intake aperture is elongate in a direction substantially orthogonal to the longitudinal axis of said cover.

6. The filter cartridge according to claim 1 , wherein said cover comprises the covering surface and peripheral sidewalls, the plane of said sidewalls being substantially orthogonal to the plane of the covering surface, said sidewalls extending over the edges of said inner receptacle defining said open end thereof, said intake aperture being provided in said covering surface, and the cartridge being configured such that, in said second configuration, the edges of said open end of said inner receptacle are in close contact with the cover at or adjacent the location at which the sidewalls extend from the periphery of the covering surface.

7. The filter cartridge according to claim 1, wherein a flexible diaphragm is provided in said connecting portion of said filter cartridge.

8. The filter cartridge according to claim 1, wherein said cartridge is disposable.

9. The filter cartridge according to claim 1, wherein said inner receptacle comprises a tapered slider portion on an outer wall thereof, and located at the end adjacent the intake aperture, and wherein a slider support portion is provided on an adjacent inner wall of said cover, said slider and slide support being in slidable communication with each other during movement of said cover between said first and second configurations.

* * * * *